US009406470B2

(12) United States Patent
Rakuff et al.

(10) Patent No.: US 9,406,470 B2
(45) Date of Patent: Aug. 2, 2016

(54) TRI-STABLE FLEXURE MECHANISM

(71) Applicant: General Electric Company, Schenectady, NY (US)

(72) Inventors: Stefan Rakuff, Clifton Park, NY (US); Donald S. Farquhar, Schenectady, NY (US); Ganesh Krishnamoorthy, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 10 days.

(21) Appl. No.: 14/183,212

(22) Filed: Feb. 18, 2014

(65) Prior Publication Data

US 2015/0235794 A1 Aug. 20, 2015

(51) Int. Cl.

| | |
|---|---|
| ***H01H 71/10*** | (2006.01) |
| ***H01H 50/64*** | (2006.01) |
| ***H01H 71/52*** | (2006.01) |
| ***H01H 50/32*** | (2006.01) |
| ***H01H 73/38*** | (2006.01) |
| *H01H 5/06* | (2006.01) |
| *H01H 5/18* | (2006.01) |

(52) U.S. Cl.

CPC ..... *H01H 50/645* (2013.01); *H01H 50/32* (2013.01); *H01H 50/643* (2013.01); *H01H 71/10* (2013.01); *H01H 71/52* (2013.01); *H01H 71/522* (2013.01); *H01H 73/38* (2013.01); *H01H 5/06* (2013.01); *H01H 5/18* (2013.01)

(58) Field of Classification Search

CPC ..... H01H 73/38; H01H 73/50; H01H 71/10; H01H 71/52; H01H 71/522; H01H 71/528

See application file for complete search history.

(56) References Cited

U.S. PATENT DOCUMENTS

| | | | | |
|---|---|---|---|---|
| 3,147,353 | A * | 9/1964 | Leonard | H01H 71/501 337/52 |
| 3,206,570 | A | 9/1965 | Harder | |
| 4,472,701 | A | 9/1984 | Bellows et al. | |
| 4,593,497 | A | 6/1986 | O'Dell et al. | |
| 5,258,733 | A | 11/1993 | Link et al. | |
| 5,266,760 | A | 11/1993 | Link et al. | |
| 6,100,777 | A | 8/2000 | Mueller et al. | |

(Continued)

FOREIGN PATENT DOCUMENTS

| | | |
|---|---|---|
| EP | 2405545 A1 | 1/2012 |
| WO | 03012812 A1 | 2/2003 |

OTHER PUBLICATIONS

GE Industrial Systems; G.E. Industrial Circuit Breaker, 1991, pp. 1-15.

(Continued)

*Primary Examiner* — Ramon M Barrera
(74) *Attorney, Agent, or Firm* — Jason K. Klindtworth

(57) ABSTRACT

Embodiments of a tri-stable flexure mechanism are described where a resilient component is present that serves as both a structural component in the kinematic chain of the mechanism and as energy storing component of the mechanism. The resilient component maintains a movable arm and an input link in either a first stable state or a second stable state when the ends of the resilient component are held in place so that the resilient component has a state of high elastic strain energy. In a third stable state, where the resilient component is in a relaxed state of lower elastic strain energy, the mechanism may be in a tripped state distinct from the closed and open states.

17 Claims, 12 Drawing Sheets

(56) References Cited

U.S. PATENT DOCUMENTS

| | | | |
|---|---|---|---|
| 6,747,534 | B1 | 6/2004 | Mueller et al. |
| 6,879,227 | B2 | 4/2005 | Bach et al. |
| 8,197,289 | B1 | 6/2012 | Faber et al. |

OTHER PUBLICATIONS

Mitsubishi Electric Company; Molded-Case Circuit Breakers & Earth-Leakage Circuit Breakers, Jan. 2007, pp. 1-156.

* cited by examiner

TRI-STABLE FLEXURE MECHANISM

Embodiments presented herein relate generally to electrical circuit interruption with circuit breakers, and more particularly, to circuit breaker mechanisms that are constructed as tri-stable planar flexure mechanisms with resilient components for use in Molded Case Circuit Breakers (MCCB).

BACKGROUND

MCCBs are employed to interrupt DC or AC, single-phase or multi-phase, electrical circuits for protection of the electrical infrastructure when an electrical fault condition occurs. The electrical fault conditions can include an instantaneous current in the circuit that exceeds a predefined instantaneous current limit (i.e., an electrical short exists) or a long-term current that exceeds a predefined long-term current limit (i.e., an overload condition exists). A single-break MCCB typically comprises one pair of electrical contacts for each phase, with each pair consisting of a stationary contact mounted to a stationary current loop and a movable contact mounted to a contact arm. A dual-break MCCB comprises two pairs of electrical contacts per phase. Per phase there are two stationary contacts and a contact arm with two movable contacts. A circuit breaker mechanism interrupts the flow of electrical current by separating the movable contacts from the stationary contacts, thereby transitioning from a closed to a tripped state.

In conventional approaches, the circuit breaker mechanism moves from the closed to the tripped state by releasing stored elastic strain energy from a helical tension spring and converting it to kinetic energy of the mechanism links. The release of elastic strain energy begins by disengaging a cradle from a latch assembly that helps hold the spring under tension in normal operation when the circuit breaker mechanism is closed. The latch assembly can be disengaged by an automatic trip unit that senses and responds to an electrical fault or manually by an operator pressing a "push-to-trip" button.

The energy to separate the movable contact and contact arm from the stationary contact may also come from an electromagnetic field that develops around the stationary current loop and the contact arm due to the short circuit currents that flow through these components. The interactions between the electromagnetic field and the short circuit current result in a repulsive force between the stationary current loop and the contact arm which causes them to move apart (i.e., "blow-open"). The magnitude of the repulsive force diminishes as the current and electromagnetic field intensity drop when the contacts start to separate. The circuit breaker mechanism has to be capable of preventing the contact arm from reclosing with the stationary contact.

Once tripped, the circuit breaker mechanism remains tripped and indicates this state to an operator. The circuit breaker mechanism is typically resettable after being tripped by moving a handle from the tripped position to the open (i.e., off) position. This increases the elastic strain energy of the spring and engages the cradle with the latch assembly. Once reset the electrical circuit can be closed by moving the handle from the open position to the closed (i.e., on) position. MCCBs may also be used to interrupt and close electrical circuits in absence of electrical faults by moving a handle between the closed and open positions.

The movement of the contact arm from the closed position to the tripped position should be fast to minimize the formation of arcs that may degrade the contacts and thereby increase the overall electrical resistance of the circuit breaker. Similarly, when a handle is used to transition the circuit breaker mechanism between the closed state and the open state, the contacts have to move quickly even if the handle motion is slow. This characteristic is called "quick make-break". The circuit breaker mechanism has to be of suitable size to fit in a predefined circuit breaker casing or electrical panel. The circuit breaker mechanism should be insensitive to wear, contamination, long-term fatigue, vibrations, temperature and humidity to prevent unintended nuisance trips or a no-trip situation.

Due to these design criteria, conventional circuit breaker mechanisms have a variety of moving components. Correspondingly, they are difficult to assemble and have a high number of failure modes, sources for friction and other uncertainties affecting their performance characteristics. In addition, conventional circuit breaker mechanisms may be larger than desired and still not meet all of the design criteria with regard to the opening speed or repeatability of the displacement input or force input at which they can be tripped.

Therefore, there is a need for circuit breaker mechanisms that are less complex, have more repeatable performance characteristics, are easier to assemble, are smaller in size, have faster opening times and more repeatable displacement or force inputs at which they can be tripped.

BRIEF DESCRIPTION

In a first embodiment, an actuation system is disclosed. In accordance with the embodiment, the actuation system includes a latch assembly configured to releasably engage a cradle. The actuation system also includes a movable arm as well as a resilient component that includes a first end having a revolute joint on the cradle and a second end connected to the movable arm. The resilient component is elastically deformed and stores elastic strain energy in one of a first stable state or a second stable state when the latch assembly is engaged with the cradle. The resilient component is in a third stable state that is not substantially elastically deformed and stores substantially no elastic strain energy when the latch assembly is not engaged with the cradle. The actuation system also includes an input link engaged with the resilient component between the first end and the second end. Movement of the input link between a first position and a second position when the latch assembly is engaged with the cradle transitions the resilient component between the first stable state and the second stable state.

In another embodiment, a method for actuating a movable arm is disclosed. The method includes: maintaining a resilient component under a state of elastic strain energy in a first stable state; holding a movable arm in a first stable position while the resilient component is in the first stable state; in response to a displacement input or a force input, releasing the elastic strain energy from the resilient component so that the resilient component is in a third stable state corresponding to a relaxed state; in response to the released elastic strain energy, rotating the movable arm so that it is no longer in the first stable position; and in response to the released elastic strain energy, moving an input link to a tripped position.

In a further embodiment, a circuit breaker assembly is disclosed. In accordance with the embodiment, the mechanism includes a latch assembly configured to releasably engage a cradle. The mechanism also includes a movable arm configured to move between a closed circuit position and an open circuit position. The mechanism also includes a leaf flexure comprising a first end having a revolute joint on the cradle and a second end connected to the movable arm.

BRIEF DESCRIPTION OF THE DRAWINGS

These and other features, aspects, and advantages of the present invention will become better understood when the following detailed description is read with reference to the accompanying figures in which like characters represent like parts throughout the figures, wherein.

DETAILED DESCRIPTION

Figure 1:
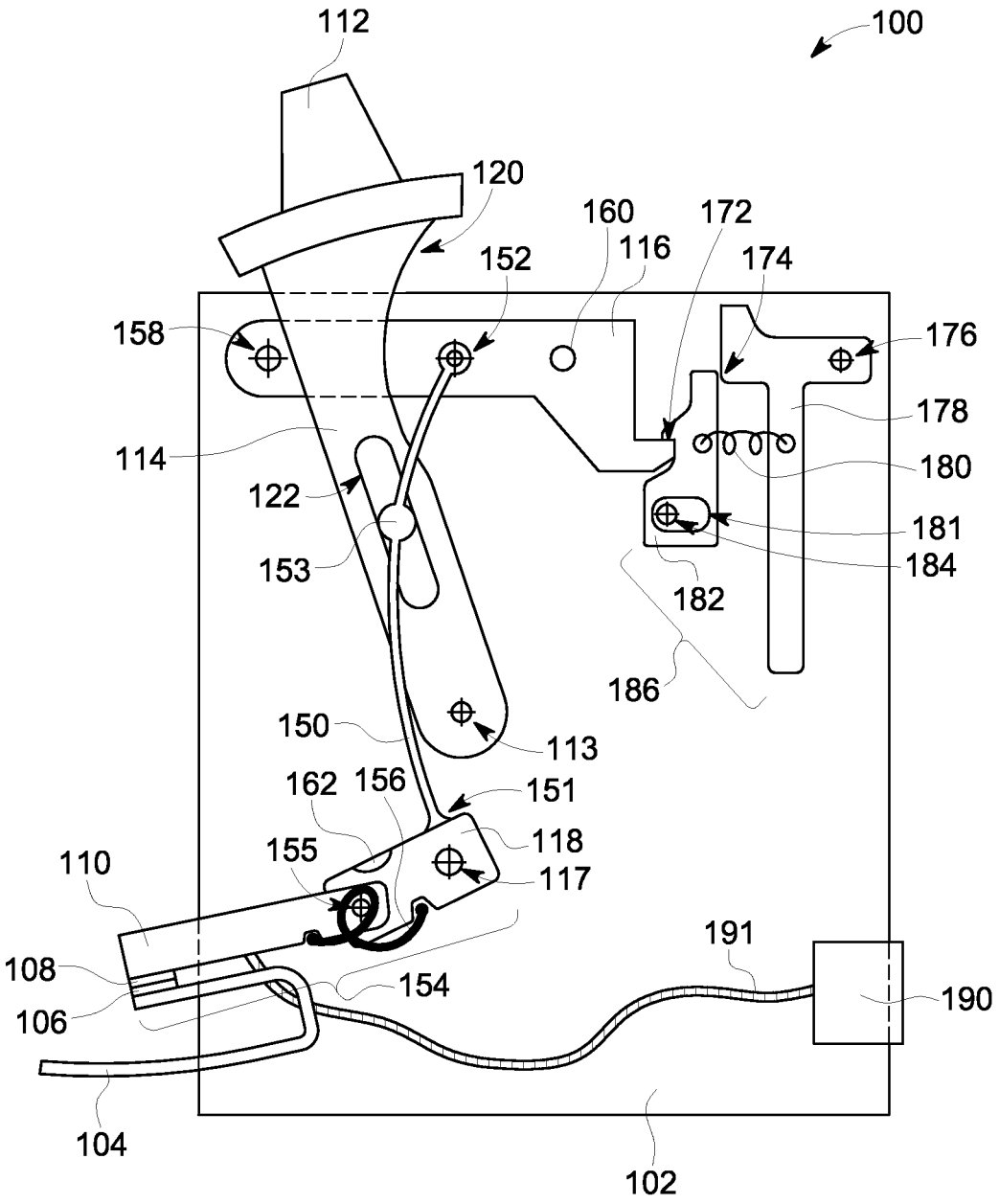
FIG. 1 depicts a schematic view of a single-phase, single-break MCCB mechanism having a leaf flexure element and contact arm assembly in a closed state, in accordance with aspects of the present disclosure.

Embodiments presented herein relate generally to electrical circuit interruption, and more particularly, to the use of tri-stable planar flexure mechanisms that use resilient components. The mechanisms presented herein are, in one embodiment, for use in MCCBs. In certain such embodiments, the mechanisms presented herein are designed to move an electrical contact arm assembly in a single phase breaker or multiple contact arm assemblies in a multi-phase breaker in order to achieve the electrical circuit interruption. The MCCB may be configured as single-break with one stationary contact and one movable contact per phase or as dual-break with two stationary contacts and two movable contacts per phase.

As discussed herein, separation of the electrical contacts may be accomplished by releasing elastic strain energy stored in a resilient component and converting it to kinetic energy of the mechanism links. The resilient component may be provided as a leaf flexure element or other suitable component having a first end having a revolute joint on a cradle and a second end connected to the contact arm assembly. The release of elastic strain energy may be initiated by disengaging a cradle from a latch assembly that helps to constrain the resilient component in normal operation when there is no electrical fault. The latch assembly can be disengaged by a displacement or force input from a trip unit that senses and responds to an electrical fault or by an operator pressing a "push-to-trip" button. In certain embodiments discussed herein, the trip unit may use a bi-metallic strip that heats and deforms in an over-current situation and a magnetic flapper that deflects in the presence of electromagnetic fields that are generated in the presence of short circuit currents.

The energy to separate the movable contacts from the stationary contacts may also come from electromagnetic fields that develop around the stationary current loop and the contact arm due to the short circuit currents that flow through these components. The result is a repulsive force between the stationary current loop and the contact arm which causes them to move apart (i.e., "blow-open"). The magnitude of the repulsive force will diminish rapidly as the current levels drop when the electrical contacts start to separate. As discussed herein, the mechanisms disclosed are capable of preventing the movable contact arm from reclosing with the stationary contact after the repulsive force diminishes by being tripped by a trip unit and by releasing elastic strain energy to rotate the contact arm assembly so that it can no longer contact the stationary contact.

With the preceding in mind, the planar flexure mechanisms, as discussed herein, may be suitable for use in either residential, commercial, or industrial use MCCBs with operating voltages up to 1 kV DC or 1 kV AC at 50 Hz or 60 Hz and operating currents between 5 A and 2 kA. The rated short-circuit interrupt current can be more than tenfold higher than the rated operating current. The MCCB mechanisms, as discussed herein, may be suitable for opening times of the contact arm assembly between 1 ms and 100 ms and contact forces of 0.1 N to 100 N between the stationary and movable contacts. As discussed herein, various embodiments of the mechanism are described where resilient components are utilized that can function as both, devices that can store and release elastic strain energy and as structural components (i.e., links) in the kinematic chain (i.e., linkage) of the mechanism. As discussed herein, such resilient components can be leaf flexure elements, collapsible compression helical springs, volute springs, or curled flexure elements which are employed to maintain a contact arm assembly and a handle yoke in either a first stable closed position or a second stable open position while they have high elastic strain energy. In a third state, where the cradle is disengaged from the latch assembly and the resilient components are in a relaxed state with lower elastic strain energy, the circuit breaker mechanism may be in a tripped state distinct from the closed and open states. The resilient components as discussed herein may allow a reduction in the number of components in the circuit breaker assembly and, therefore, reduce the complexity of the circuit breaker, improve reliability and scalability of the design, and provide a lower mass and mass moment of inertia than a mechanism with conventional components, enabling higher speeds of operation.

As used herein, resilient components are integrated into the mechanism such that these components have a mode of higher elastic strain energy and such that the mechanism has a first stable state and a second stable state while the cradle stays engaged with a latch assembly. In the embodiments presented herein, when the mechanism is in the first stable state, reaction forces and reaction moments of the resilient components create a moment about a revolute joint of the contact arm assembly so that the movable contacts contact the stationary contacts and so that the handle yoke is held in the closed position. When the mechanism is in its second stable state, reaction forces and reaction moments of the resilient components create a moment about a revolute joint of the contact arm assembly to disconnect the movable contacts from the stationary contacts and to hold the handle yoke in the open position. A transition between the first stable state and second stable state of the mechanism can be made by means of the handle yoke that is mechanically coupled to the resilient component. The opening and closing of the stationary contacts and the movable contacts happen rapidly and are nearly independent of the handle yoke speed once the resilient component transitions through an unstable bifurcation point. This behavior is referred to as "mechanism snap-through" and provides a "quick make-break" characteristic. Furthermore, at a third stable state, where the resilient components have a mode of lower elastic strain energy, the cradle is disengaged from the latch assembly, and the mechanism is in a tripped state. The mechanism can transition from the first stable state to the third stable state by means of releasing the cradle from the latch assembly and from the third stable state to the second stable state by moving the handle yoke from tripped to closed.

By way of example, and as discussed in greater detail below, in a first embodiment, the resilient component is a leaf flexure element that is mounted between two ends, one of which is rigidly fixed to a crank which is part of a contact arm assembly and that forms a revolute joint with the mechanism frame. The rigid connection between the leaf flexure element and the crank is located at the revolute joint of the crank. The other end of the leaf flexure element has a revolute joint on a cradle. A handle yoke having a revolute joint on the mechanism frame connects to the leaf flexure element through a slot and a protrusion on the flexure forming a revolute joint and a prismatic pair between the handle yoke and the leaf flexure element. In this example, in normal operation, the cradle is held stationary by a latch assembly with which it engages. When the handle yoke is moved from the closed position to the open position the leaf flexure element eventually reaches a bifurcation point and transitions from the first stable position to the second stable position. The "mechanism snap-through" happens quickly and nearly independent of the speed of the handle yoke. Similarly, there is "mechanism snap-through" behavior when the handle yoke is moved from the open position to the closed position. Further, when disengaged from the latch assembly, the cradle rotates about a revolute joint on the mechanism frame as a result of the reaction forces exerted upon it by the leaf flexure element. The rotation of the cradle causes the revolute joint between the cradle and leaf flexure element to relocate with respect to the mechanism frame, and the leaf flexure element reaches its unstressed shape with low elastic strain energy content. As a result of the leaf flexure element transitioning from a mode of high elastic strain energy to a mode of low elastic strain energy, the crank and contact arm assembly as well as the handle yoke accelerate from the closed position to the tripped position.

With the preceding in mind, and turning to FIG. 1, a schematic view of certain components of the embodiment of an MCCB mechanism 100, are depicted that are in accordance with the present disclosure. In this embodiment and as depicted, the mechanism 100 is in the closed state as can be seen by the contact between the movable contact 108 and the stationary contact 106. Furthermore, an electrically conductive current path may exist between the stationary current loop 104, the stationary contact 106, the movable contact 108, the contact arm 110, the flexible conductor 191, and the stationary terminal 190. The contact arm assembly 154 comprises a crank 118 that has a crank revolute joint 117 on the mechanism frame 102, a contact arm 110 that has a contact arm revolute joint 155 on the crank 118, and a torsion spring 156 connected to both the crank 118 and the contact arm 110. The leaf flexure element 150 exerts a moment on the crank 118 which is transmitted through the torsion spring 156 to the contact arm 110 resulting in a contact force normal to the contact interface between the movable contact 108 and the stationary contact 106.

In the depicted example, the leaf flexure element 150 is in a first stable closed position, held in a stressed and deformed state of high elastic strain energy by the cradle 116 which is secured to the latch assembly 186. One end of the leaf flexure element 150 has a flexure revolute joint 152 on the cradle 116 (i.e., there still can be relative rotational motion between the cradle and the leaf flexure element). The other end of the leaf flexure element 150 forms a rigid flexure connection 151 with the crank 118 (i.e., there is no relative motion possible between the crank and the leaf flexure element). The crank revolute joint 117 is in close proximity to the rigid flexure connection 151. In one embodiment the leaf flexure element 150 consists of a 65 mm×15 mm×1 mm unidirectional fiber glass composite that has a rigid flexure connection 151 to the crank 118. The rigid flexure connection 151 is located less than 10 mm away from the crank revolute joint 117.

In the depicted embodiment, mechanism 100 includes a link in the form of a handle yoke 114 that is connected to a handle switch 112 and that has a handle yoke revolute joint 113 on the mechanism frame 102. The handle yoke 114 has a handle yoke slot 122 that is engaged with a flexure protrusion 153, thus forming a prismatic pair and a revolute joint, respectively, between the handle yoke 114 and the leaf flexure element 150 (i.e., a pivot is formed that can move linearly with respect to the handle yoke). In this manner, a change in state of the leaf flexure element 150, either by operation of the latch assembly 186, the contact arm assembly 154, the cradle 116, or the handle yoke 114, may be communicated to the other interconnected parts to change the positions of those interconnected parts.

In the depicted example, a latch assembly 186 is also shown which, when engaged holds the mechanism in either the closed or open states. The depicted latch assembly includes a primary latch 182 that may be engaged with cradle 116 at primary latch interface 172 and with a secondary latch 178 that may be engaged with primary latch 182 at secondary latch interface 174. In the depicted example, a latch bias spring 180 is provided between the primary latch 182 and the secondary latch 178 such that, when disengaged from one another, the latch bias spring 180 can bias the primary latch 182 and the secondary latch 178 towards one another such that the cradle 116 can be reengaged by moving the handle yoke 114 after the mechanism has been tripped. As will be appreciated, the depicted latch assembly 186 is a dual latch assembly (i.e., there are two engagements, the first between the primary latch 182 and the secondary latch 178 and the second between the primary latch 182 and the cradle 116). In other embodiments, the latch assembly may differ, such as being a single latch assembly between a primary latch and cradle, or a triple or greater latch assembly, having more than two latches.

Contact arm assembly 154 comprises a contact arm 110 that has a contact arm revolute joint 155 located on crank 118. A contact arm torsion spring 156 creates a moment between crank 118 and movable contact arm 110. In the depicted closed state of the MCCB mechanism 100, the crank 118 is oriented such that the contact arm 110 is rotated away from contact arm hard stop 162 which results in a contact force between the movable contact 108 and the stationary contact 106. The deflection of the contact arm 110 with respect to the contact arm hard stop 162 is known as "contact arm depression". In other embodiments discussed herein, the torsion spring 156, the contact arm revolute joint 155, and the contact arm hard stop 162 may be absent, and the resilient component may directly attach to the contact arm 110. In this case the resilient component directly generates the moment required for a contact force between the movable contact 108 and the stationary contact 106. Also in this case, the leaf flexure element 150 may directly provide the necessary compliance for a "blow-open" event to occur.

Figure 2:
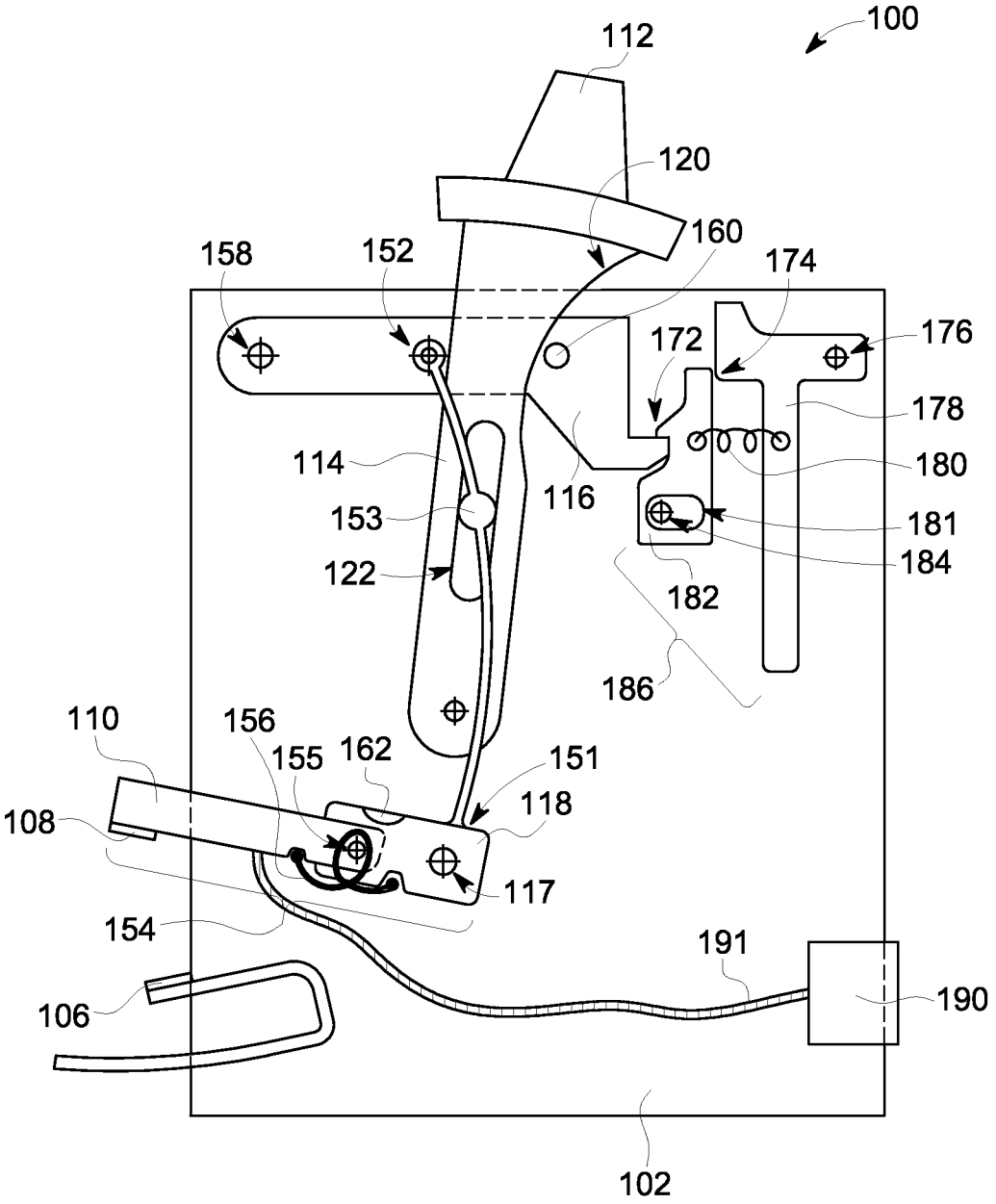
FIG. 2 depicts a schematic view of a single-phase, single-break MCCB mechanism having a leaf flexure element and a contact arm assembly in an open state, in accordance with aspects of the present disclosure.

In FIG. 2, mechanism 100 is shown in the second stable state or "open" position. The contact arm assembly 154 consists of a contact arm 110, the movable contact 108, a contact arm revolute joint 155, the crank 118, a contact arm torsion spring 156, and the contact arm hard stop 162. The contact arm 110 is rotated counter clockwise about the contact arm revolute joint 117 with respect to the crank 118 because of the moment applied by the contact arm torsion spring 156 such that the contact arm 110 is in contact with the contact arm hard stop 162. This orientation of the contact arm assembly is typical whenever the contact arm assembly is not in contact with the stationary contact 106.

In general, it may be desirable to move the circuit breaker mechanism 100 between the closed position depicted in FIG. 1 and an open position depicted in FIG. 2 without tripping it. That is, it may be desirable to allow an operator to open the electrical circuit in a manner distinct from tripping the circuit breaker mechanism. For example, the MCCB mechanism 100 of FIG. 2 is depicted in an open position, as shown by the contact arm assembly 154 being separated from the stationary contact 106. The MCCB mechanism 100 may be opened in this manner by a user or operator moving the handle yoke 114 from the position shown in FIG. 1 to the position of the handle yoke 114 shown in FIG. 2. It may also be desirable to allow an operator to close the electrical circuit by moving the handle yoke 114 from the position shown in FIG. 2 to the position shown in FIG. 1.

Figure 3:
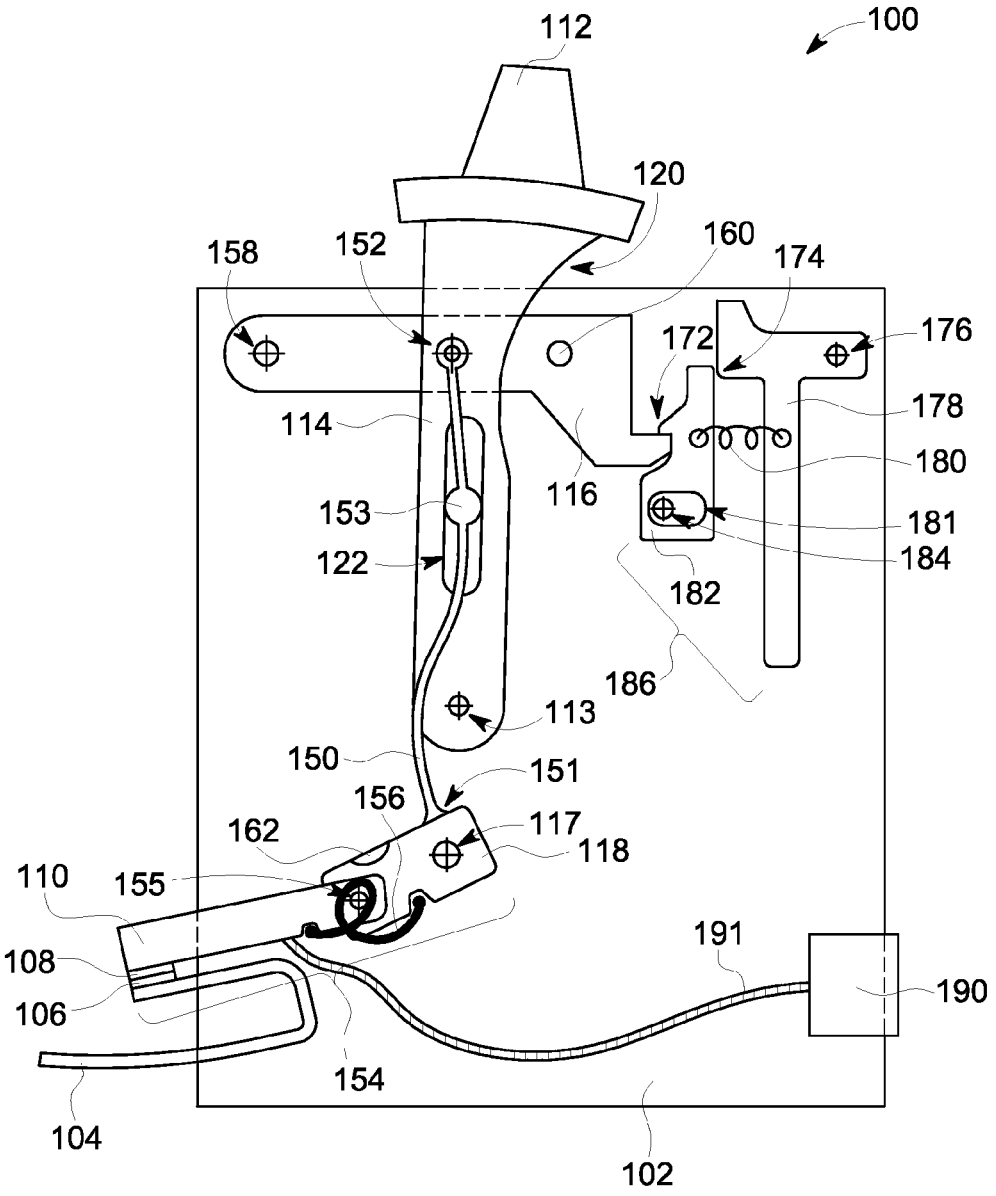
FIG. 3 depicts a schematic view of a single-phase, single-break MCCB mechanism at the bifurcation point of the leaf flexure element when transitioning from closed to open, in accordance with aspects of the present disclosure.
Figure 4:
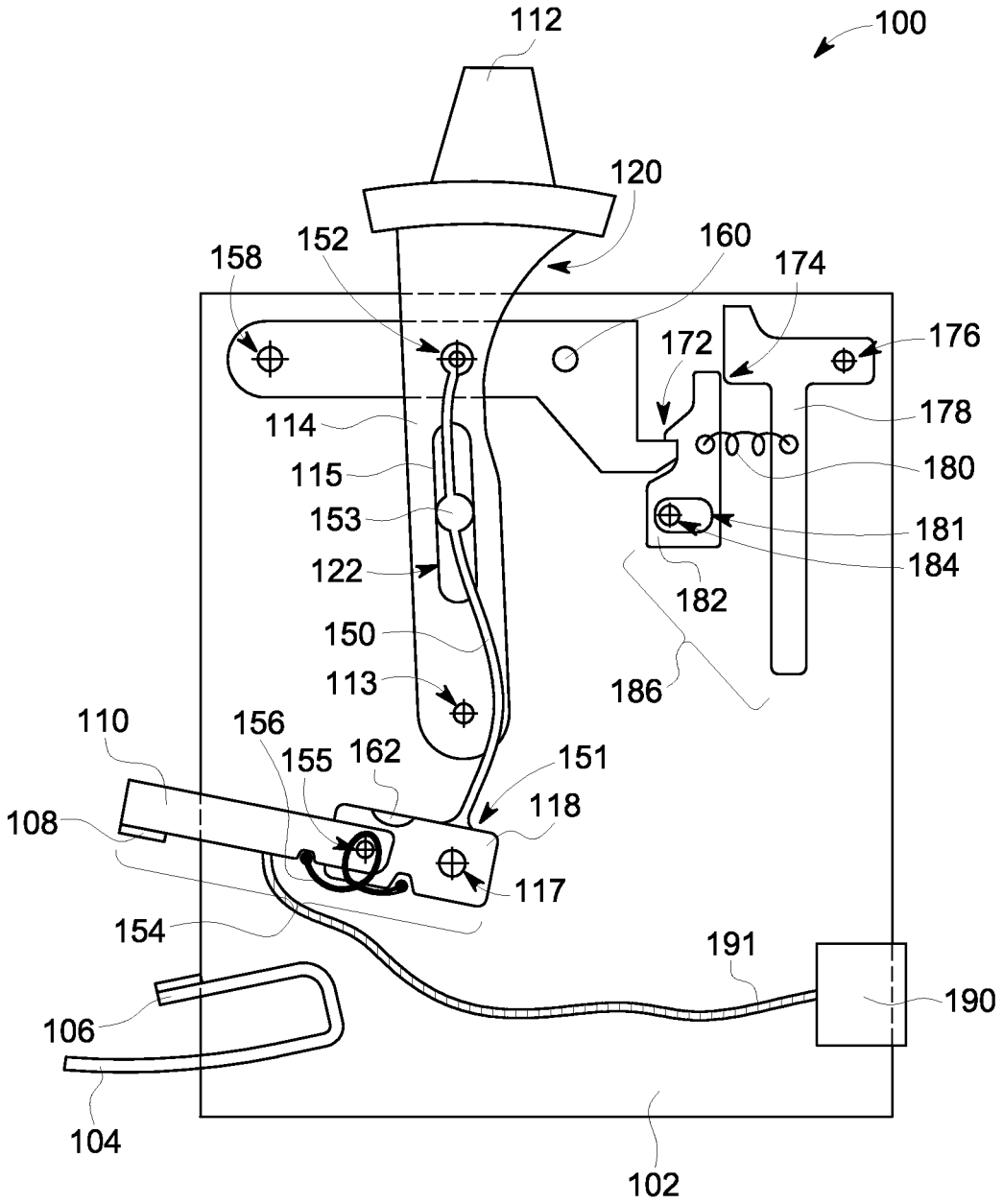
FIG. 4 depicts a schematic view of a single-phase, single-break MCCB mechanism at the bifurcation point of the leaf flexure element when transitioning from open to closed, in accordance with aspects of the present disclosure.

Turning to FIG. 3, the MCCB mechanism 100 is shown in a mode between the first and second stable states when the handle yoke 114 and handle switch 112 are moved from closed to open. Because the latch assembly 186 is unchanged, unmoved and remains engaged, the end of the leaf flexure element 150 connected to the cradle 116 via the flexure revolute joint 152 remains secured and stationary with respect to the mechanism frame 102. Movement of the handle yoke 114 causes a force to be applied by the handle yoke slot 122 onto the flexure protrusion 153. As a result of the force the leaf flexure element 150 starts to be deflected away from its first stable closed position towards its bifurcation point between the first and second stable states. Moving the handle yoke 114 even further towards the position shown in FIG. 2 the bifurcation point of the leaf flexure element 150 is reached and the transition towards the state of the mechanism shown in FIG. 2. This transition happens suddenly and rapidly and is nearly independent of the speed at which the handle yoke is moved by the operator resulting in a "quick break" of the electrical circuit and minimal electrical arcing. Motion at the prismatic and revolute pair can be in the form of sliding and rotation of the leaf flexure element 150 with respect to the handle yoke 114. Turning to FIG. 4, MCCB mechanism 100 is shown in a mode between the first and second stable states when handle yoke 114 is moved from the open to the closed position. This scenario is the reverse operation as described above, and the transition towards the state of the mechanism shown in FIG. 1 results in a "quick make" of the electrical circuit.

Figure 5:
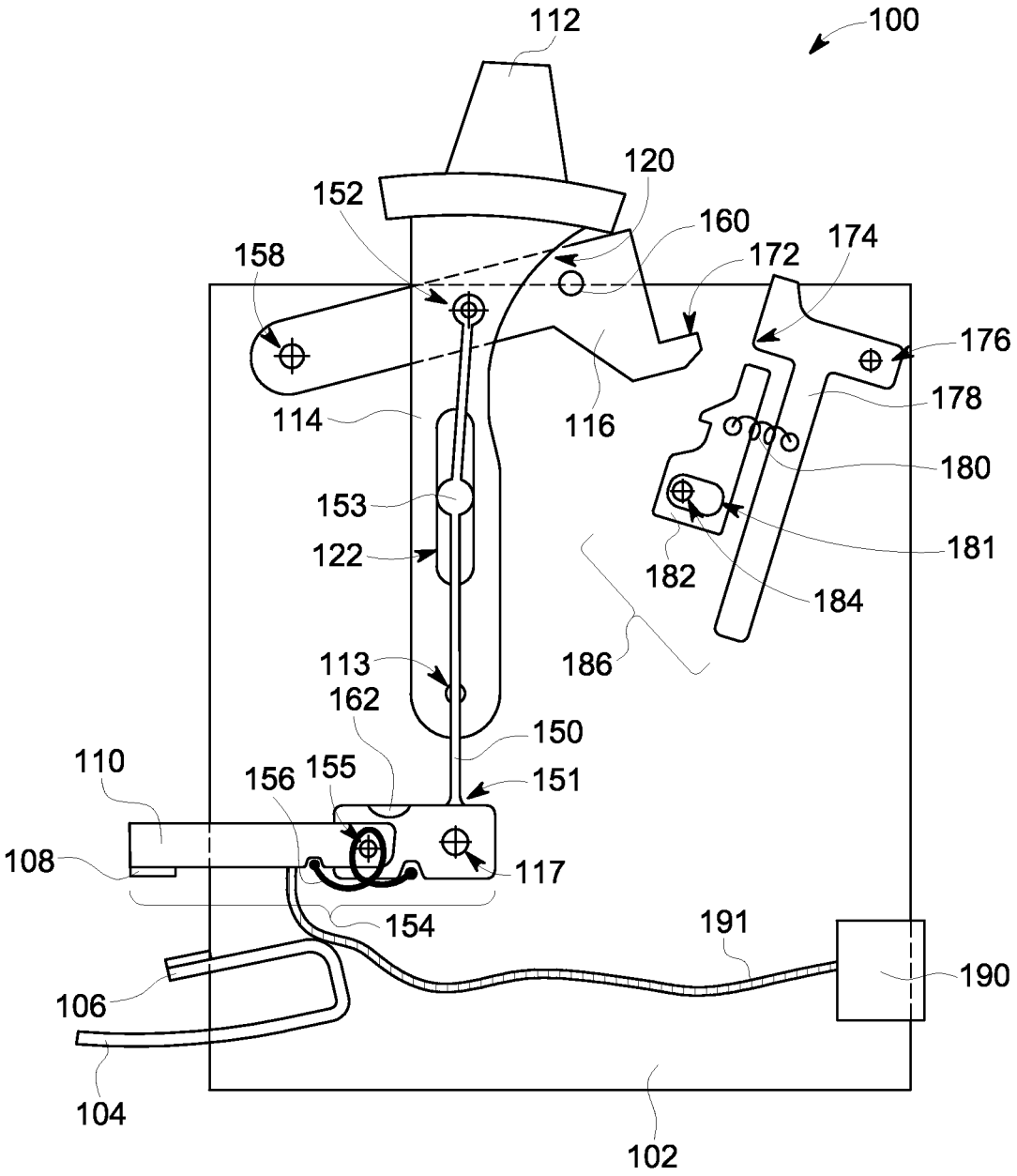
FIG. 5 depicts a schematic view of a single-phase, single-break MCCB mechanism having a leaf flexure element and contact arm assembly in a tripped state, in accordance with aspects of the present disclosure.

As shown in FIG. 5, in addition to the open state and the closed state, the MCCB mechanism 100 can also be in a third stable state (i.e., a tripped state) in which there is no contact between the movable contact 108 and the stationary contact 106 and where the leaf flexure element 150 has low elastic strain energy. This state can be reached from the closed position where the leaf flexure element 150 has high elastic strain energy and such that there is a reaction force acting on the cradle 116, which causes a counterclockwise moment of the cradle 116 about the cradle revolute joint 158. The trip event is started when a trip unit, or a "push-to-trip" button that is pushed by an operator, initiates a rotational displacement of the secondary latch 178 about the secondary latch revolute joint 176 in the clockwise direction. This causes the secondary latch interface 174 to lose contact with the secondary latch 178, and the reaction force at the primary latch interface 172 between the cradle 116 and the primary latch 182 causes the primary latch to rotate clockwise. This causes the primary latch 116 to lose contact with the primary latch interface 172 leaving the cradle 116 free to rotate counterclockwise about the cradle revolute joint 158.

To move the MCCB mechanism 100 in FIG. 1 from a closed state where the leaf flexure element 150 has a state of high elastic strain energy to a tripped state of the mechanism 100 in FIG. 5 where the leaf flexure element 150 has a state of low elastic strain energy requires that the strain energy is converted to kinetic energy of the various components of the mechanism that move during the transition and which include, for example, the handle yoke 114, the contact arm assembly 154, the latch assembly 186, the leaf flexure element 150, and the cradle 116. Relaxation of the leaf flexure element 150 results in a moment that accelerates the crank 118 from rest, allowing the contact arm assembly 154 to rotate away from the stationary contact 106, thus opening the electrical circuit. The MCCB mechanism 100 comes to a stop in the tripped configuration once the leaf flexure element 150 has transferred its elastic strain energy to kinetic energy of the moving components and once this kinetic energy has been absorbed again by friction or inelastic collision losses at the various hard stops, for example between the yoke cam 120 and the yoke follower 160. It should be noted that the torsion spring 156 may also contribute elastic strain energy in the trip event.

In the tripped state of the MCCB mechanism 100, and as shown in FIG. 5, the handle yoke 114 is in a tripped position between the closed position and the open position indicating to an operator that the MCCB mechanism 100 has tripped. In the tripped state, the leaf flexure element 150 is shown in an undeformed shape due to the flexure revolute joint 152 no longer being held stationary with respect to the mechanism frame 102 by the cradle 116. In general, to bring the contact arm assembly 154 back into contact with the stationary contact 108 after a trip event, the MCCB mechanism 100 must be moved to the open configuration (i.e., reset) prior to being moved to the closed configuration. That is, because the latch assembly 186 is disengaged when the MCCB mechanism 100 is tripped, the act of moving the handle yoke 114 from the tripped position shown in FIG. 5 to the open position shown in FIG. 2 causes the yoke cam 120 to exert a force on the yoke follower 160 which causes the cradle 116 to rotate clockwise towards the primary latch 182. At the same time, the handle yoke slot 122 exerts a force on the flexure protrusion 153 to deform the leaf flexure element 150 from the tripped state with low elastic strain energy towards the open state with higher elastic strain energy shown in FIG. 2. When the open state of the MCCB mechanism 100 is reached, the primary latch interface 172 contacts the cradle 116, and the secondary latch interface 174 contacts the secondary latch 178.

The mechanical motions of the components described above are determined by various kinematic pairs provided as part of the assembly. For example, certain kinematic pairs may be revolute joints (i.e., pivots), prismatic pairs (i.e., sliders), or cams-followers (i.e., surface-to-surface contacts). Referring to FIG. 1, the kinematic pairs may or may not be fixed in location with respect to the mechanism frame 102. Fixed kinematic pairs include revolute joints that are based on extensions or hole features of the mechanism frame 102, the circuit breaker casing wall or surface. For example, the cradle revolute joint 158 about which the cradle 116 rotates is fixed with respect to the mechanism frame 102, the crank revolute joint 117 about which the crank 118 rotates is fixed with respect to the mechanism frame 102, the secondary latch revolute joint 176 about which the secondary latch 178 rotates is fixed with respect to the mechanism frame 102, and the handle yoke revolute joint 113 about which the handle yoke 114 rotates is fixed with respect to the mechanism frame 102. The primary latch slot 181 and the primary latch pin 184 form a prismatic pair as well as a revolute joint that allow the primary latch 178 to translate as well as rotate with respect to the mechanism frame 102. This is used in resetting the latch assembly 186 after it has tripped.

Conversely, various kinematic pairs are moving with respect to the mechanism frame 102 and are defined by the structure depicted in FIG. 1, including the flexure revolute joint 152 defined by the interaction between the leaf flexure element 150 and the cradle 116. Another moving kinematic pair is the contact arm revolute joint 155, defined by the interaction between the contact arm 110 and the crank 118 (as mediated by torsion spring 156). The handle yoke slot 122 and the flexure protrusion 153 form a prismatic pair as well as a revolute joint that allows the leaf flexure element 150 to rotate as well as translate with respect to the handle yoke 114. In the depicted example, the various depicted kinematic pairs define the available motions and ranges for the depicted components in response to both internally and externally applied forces and displacements. As noted above, the MCCB mechanism 100 depicted in FIG. 1 also contains higher order kinematic pairs that are formed between surfaces of depicted components that may contact one another. For example, the yoke cam 120 may engage with the yoke follower 160 when the cradle 116 and the handle yoke 114 are in the tripped position in order to reset the mechanism from the tripped to the open configuration.

Figure 6:
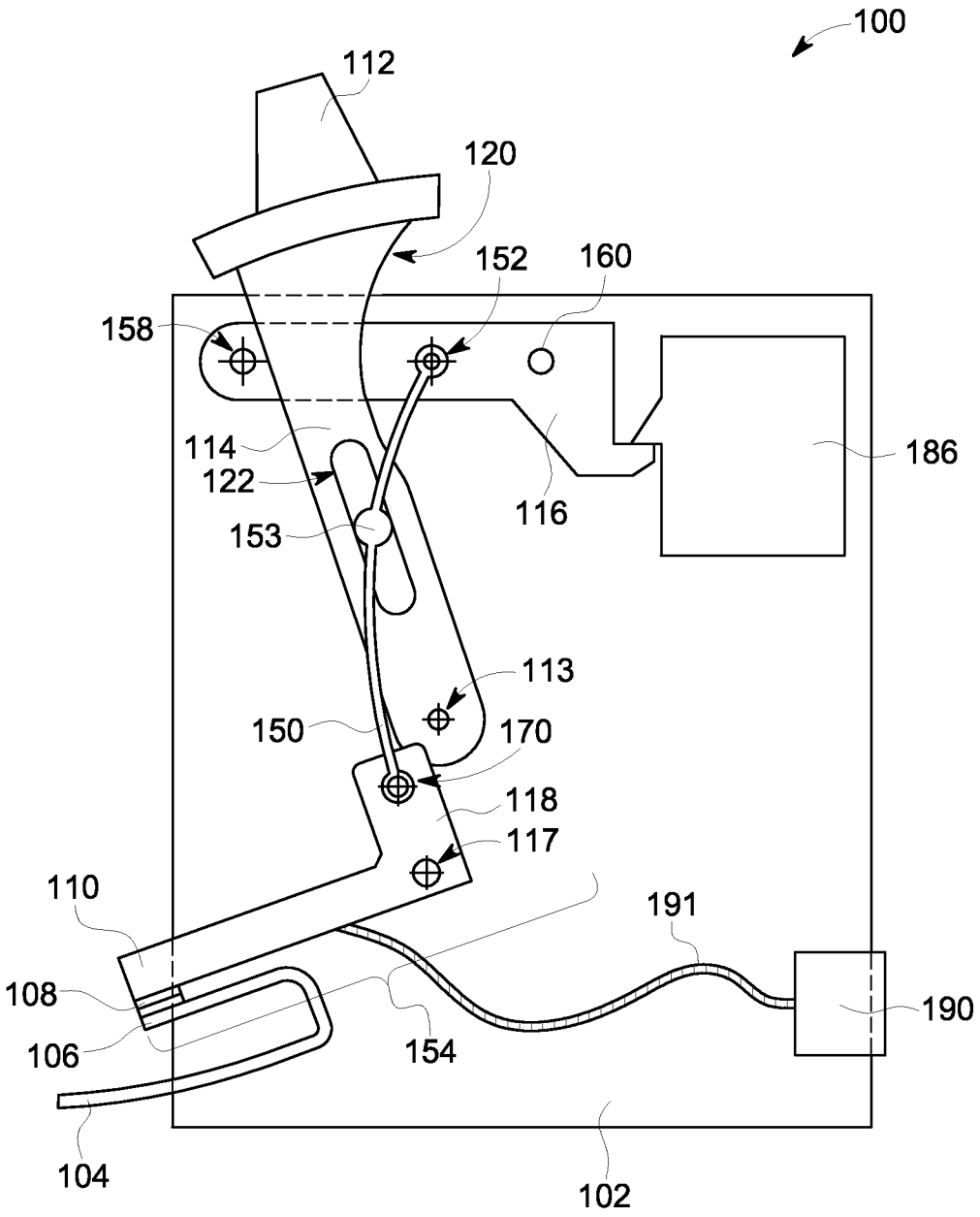
FIG. 6 depicts a schematic view of a single-phase, single-break MCCB mechanism in the closed state and having a leaf flexure element connected to a contact arm assembly by an offset revolute joint, in accordance with aspects of the present disclosure.

By way of example, in the embodiment of MCCB mechanism 100 shown in FIG. 6, the resilient component of the mechanism consists of a leaf flexure element 150 that is mounted such that a first end has a flexure revolute joint 152 on the cradle 116 and such that a second end has a secondary flexure revolute joint 170 on the contact arm 110. The secondary flexure revolute joint 170 is offset from the crank revolute joint 117 by between 2 mm and 100 mm. When the mechanism moves between the closed, open, and tripped states the curvature of the leaf flexure element 150 may or may not remain deflected to one side (i.e., the curvature of the leaf flexure element may or may not change from positive to negative and vice versa).

Figure 7:
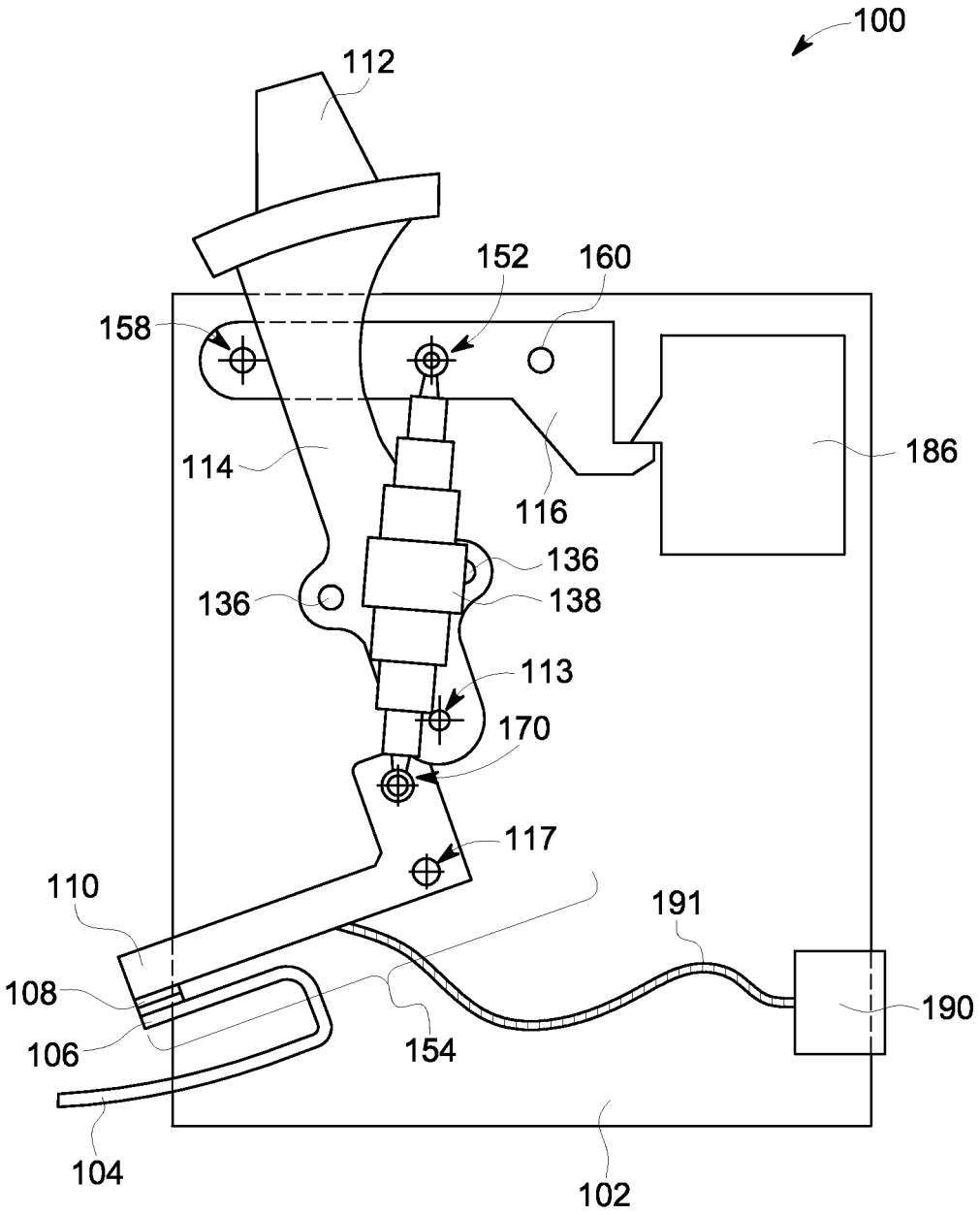
FIG. 7 depicts a schematic view of a single-phase, single-break MCCB mechanism in the closed state having a volute spring connected to a contact arm assembly by an offset revolute joint, in accordance with aspects of the present disclosure.

By way of further example, in the embodiment of mechanism 100 shown in FIG. 7, the resilient component of the mechanism consists of a volute spring that is mounted such that a first end has a revolute joint 152 on the cradle 116 and a second end has a secondary revolute joint 170 on the contact arm 110. The secondary revolute joint 170 is offset from the crank revolute joint 117. When the mechanism moves between the closed, open, and tripped states the volute spring contacts and expands primarily in its axial direction (i.e., the curvature of the volute springs remains small).

Further, in the embodiment shown in FIG. 7, handle yoke 114 has two separate structures parallel to one another with volute spring 138 positioned between these separated structures. The interface between the volute spring 138 and the handle yoke 114 is shown in the form of a pair of crossbars 136 connecting the separated components of the handle yoke 114 through which the volute spring 138 passes.

Figure 8:
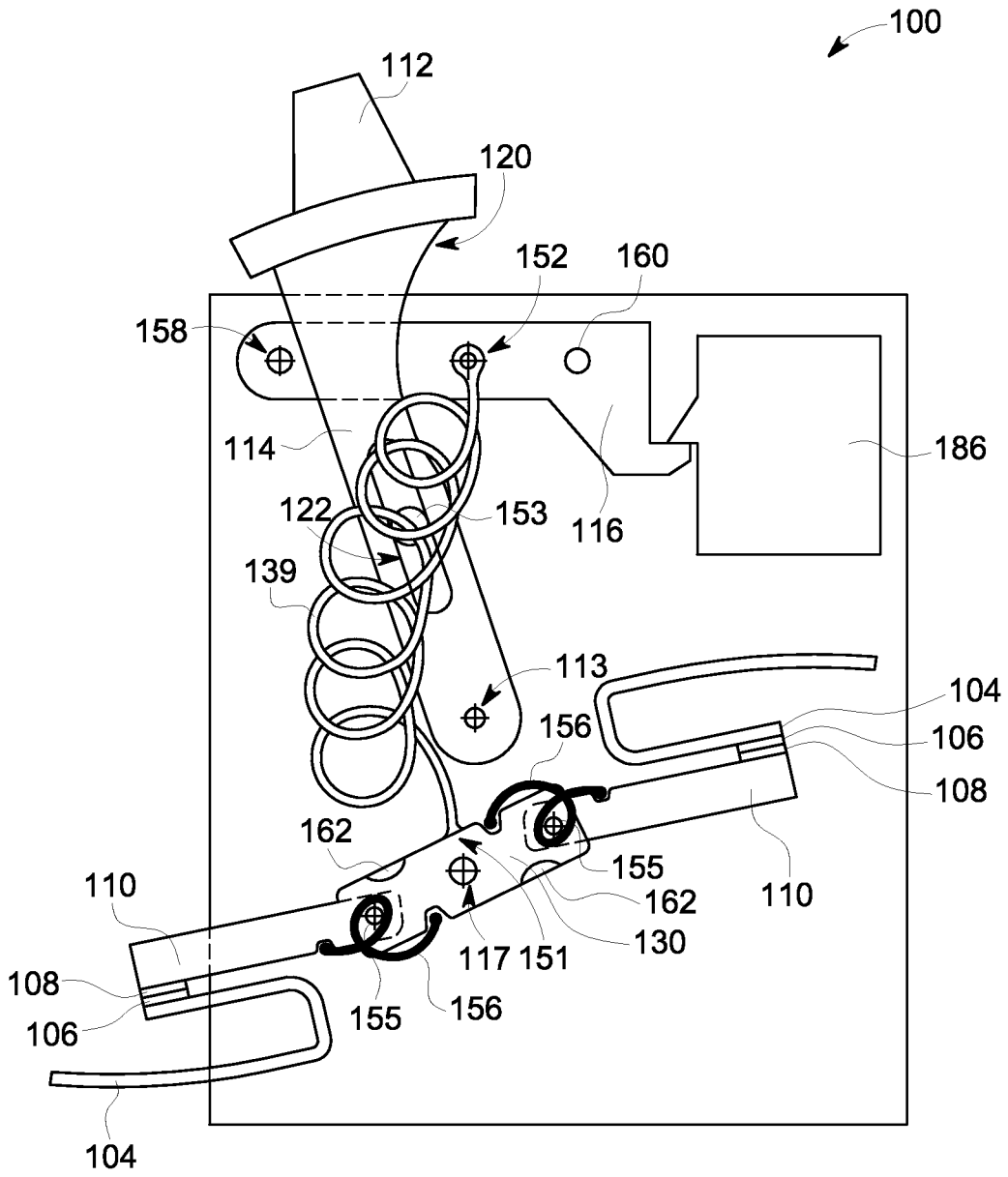
FIG. 8 depicts a schematic view of a single-phase, dual-break MCCB mechanism in the closed state and having a curled flexure element, in accordance with aspects of the present disclosure.

In an additional example, in the embodiment of the MCCB mechanism 100 shown in FIG. 8, the resilient component of the mechanism consists of a curled flexure 139 that is connected at one end to the cradle 116 via a flexure revolute joint 152 and on the other end to the crank rotor 130 via a rigid flexure connection 151. The mechanism 100 is shown as a dual-break, single phase mechanism with the contact arm assembly consisting of a crank rotor 130, two contact arm hard stops 162, two contact arms 110, two movable contacts 108, two torsion springs 156, and two contact arm revolute joints 155. Current flows through the first stationary current loop 104, the first stationary contact 106, the contact arm assembly, the second stationary contact 106, and the second stationary current loop 104.

Figure 9:
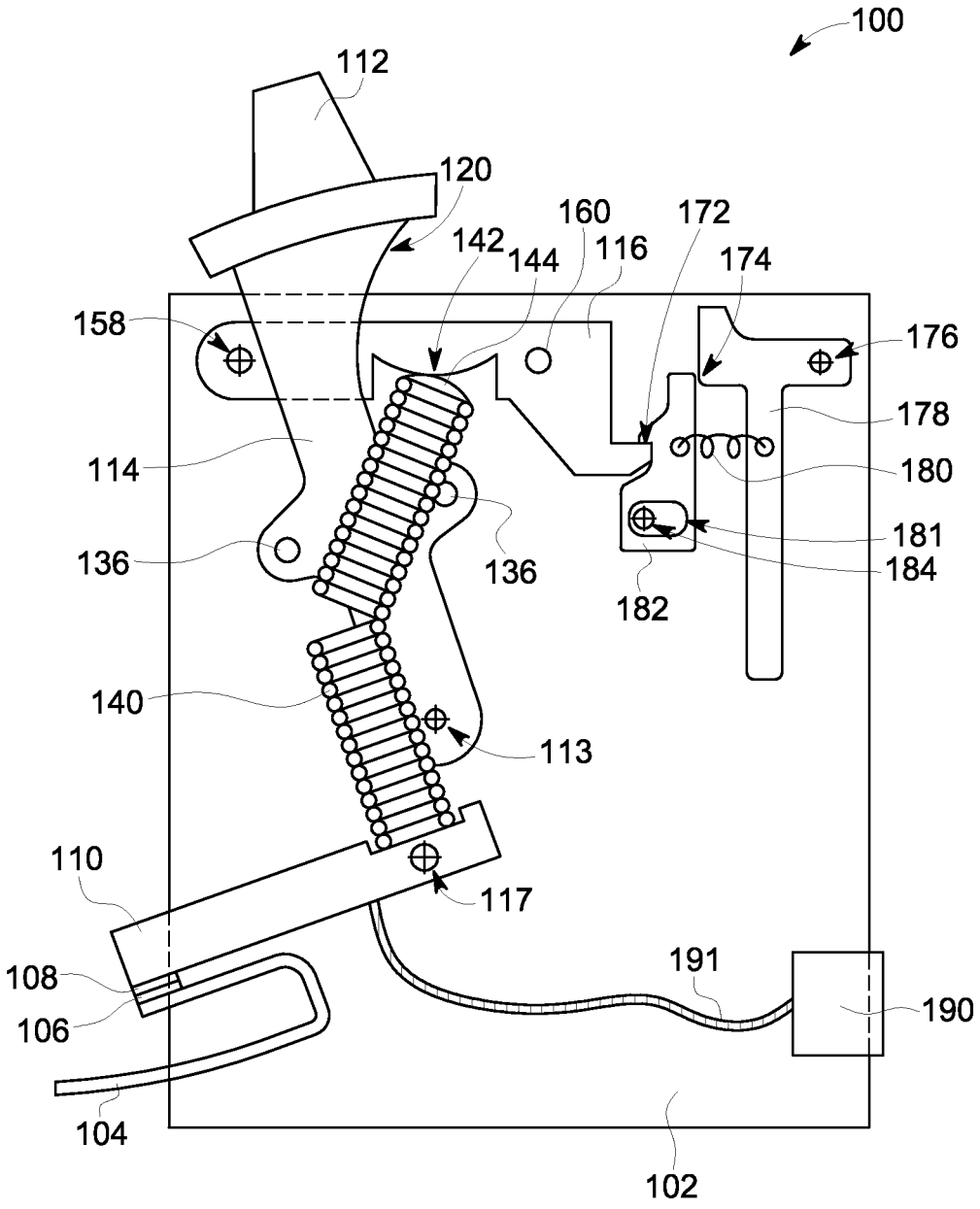
FIG. 9 depicts a schematic view of a single-phase, single-break MCCB mechanism having a compression helical spring that is collapsed to form a closed state, in accordance with aspects of the present disclosure.

By way of example, in the embodiment of the MCCB mechanism 100 shown in FIG. 9 in the first stable closed state, the resilient component of the mechanism consists of a collapsible compression spring 140 (shown in cross-section) being collapsed and compressed with a first end rigidly connected to a cradle follower 144 that is contacting the cradle 116 at a cradle cam 142. This allows in-plane rotation of the collapsible compression spring 140 with respect to the cradle 116. A second end of the spring 140 is rigidly connected to the contact arm 110.

Further, in this embodiment, the handle yoke 114 has two separate structures parallel to one another with the collapsible compression spring 140 positioned between these separated structures. The interface between the collapsible compression spring 140 and handle yoke 114 is shown in the form of a pair of crossbars 136 connecting the separated components of the handle yoke 114 through which the collapsible compression spring 140 passes.

Figure 10:
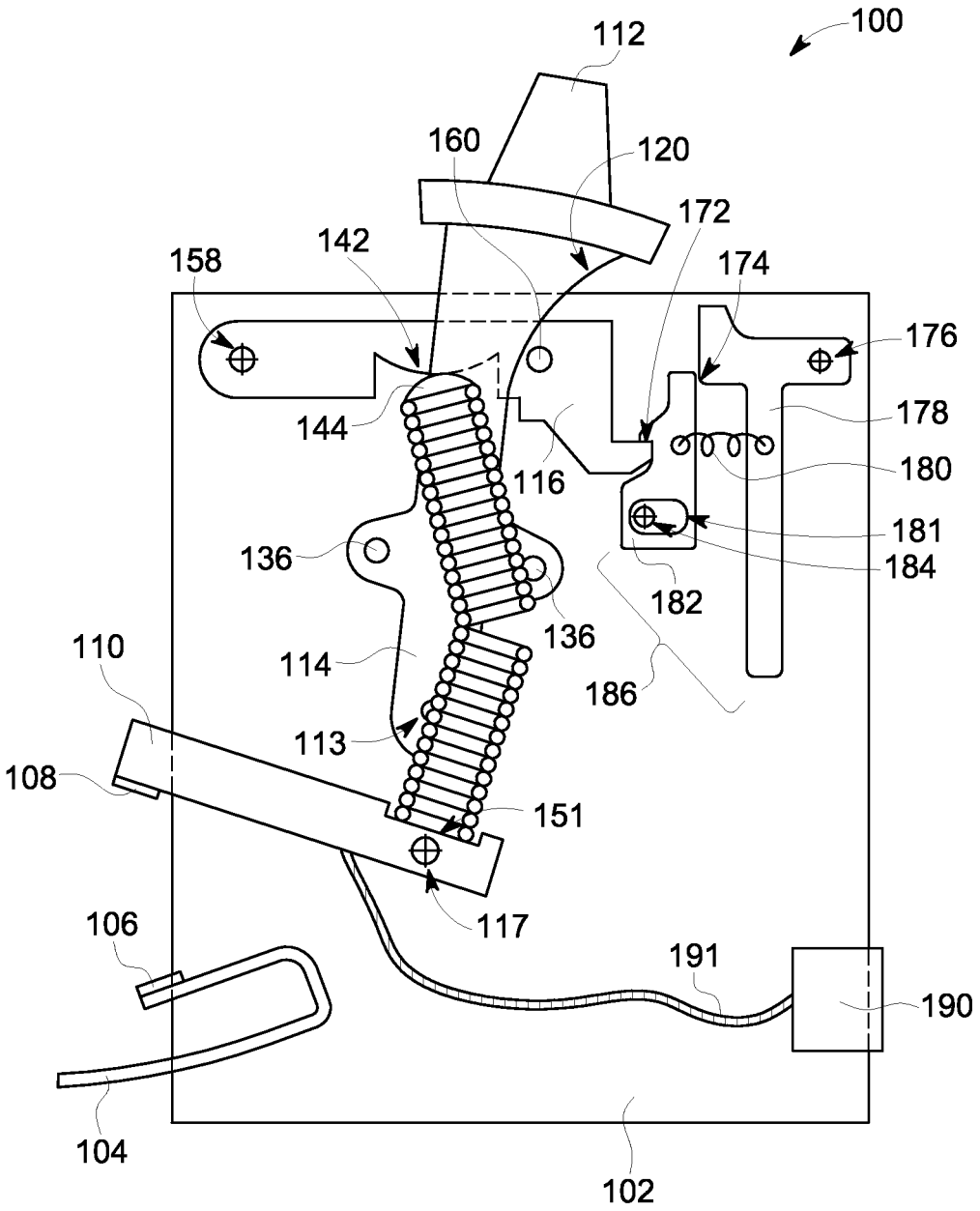
FIG. 10 depicts a schematic view of a single-phase, single-break MCCB mechanism having a compression helical spring that is collapsed to form an open state, in accordance with aspects of the present disclosure.

Turning to FIG. 10, the MCCB mechanism 100 is shown in the second stable open state where the collapsible compression spring 140 is compressed and collapsed, and the contact arm assembly consisting of the contact arm 110, the movable contact 108, and the crank revolute joint 117 does not contact the stationary contact 106.

Figure 11:
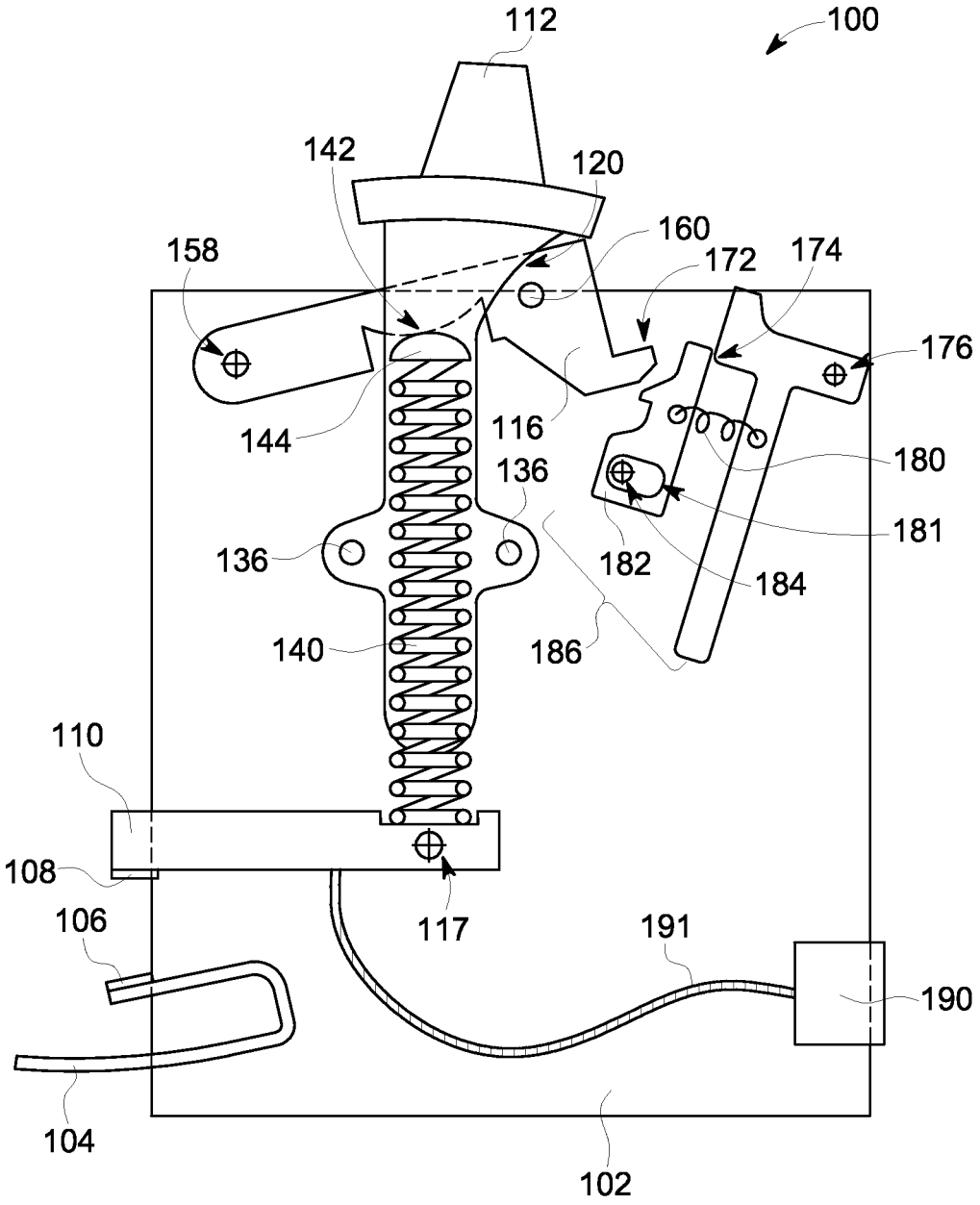
FIG. 11 depicts a schematic view of a single-phase, single-break MCCB mechanism having a compression helical spring that is expanded to form a tripped state, in accordance with aspects of the present disclosure.

Turning to FIG. 11, the MCCB mechanism 100 is depicted in its third stable tripped state. In this state the collapsible compression spring 140 is not collapsed and is less compressed than in the first and second states, having a state of lower elastic strain energy. In this example, the latch assembly 186 has been disengaged, as shown by the separation or disengagement of the cradle 116 from the primary latch 182. In response to disengagement of the latch assembly 186, the cradle 116 may rotate with respect to the cradle revolute joint 158. This rotation allows the collapsible compression spring 140 to release strain energy and move towards a relaxed state by expansion and by recovering from the collapsed state.

Figure 12:
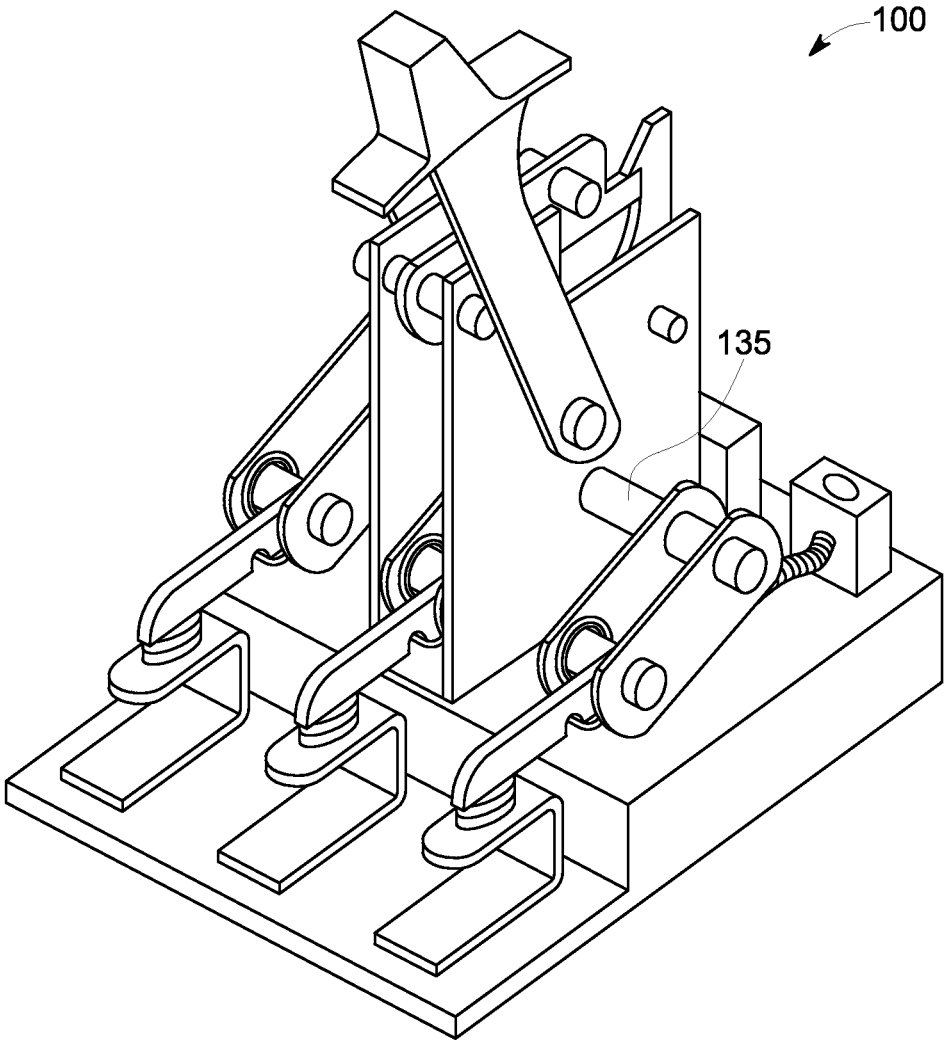
FIG. 12 depicts a perspective view of a single-break, three-phase circuit breaker in a closed state, in accordance with aspects of the present disclosure.

The preceding examples have depicted planar, and other, flexure mechanisms for MCCBs that may be used in single-phase, single-break embodiments for simplicity and to facilitate explanation. However, it should be appreciated that any of the aforementioned approaches may be applied in other configurations, such as in multi-phase (e.g. three-phase) or dual break arrangements and in AC or DC circuits. For example, and tuning to FIG. 12, depicted is a three-phase, single-break MCCB mechanism 100 that comprises a torsion bar 135 that connects three contact arm assemblies to the circuit breaker mechanism. Likewise, various arrangements of latching assemblies, external trip units, as well as contact arm assemblies other than those described may be used in conjunction with resilient components which mediate the transition from open, closed, and tripped states of the MCCB mechanism.

Technical effects of the invention include the construction and use of a MCCB mechanism incorporating resilient components that link a cradle to a contact arm assembly. In a first embodiment, the resilient component is a leaf flexure element that is rigidly connected to a contact arm assembly. In a second embodiment the leaf flexure element has a revolute joint on the contact arm assembly that is offset from the crank revolute joint. In a third embodiment, the resilient component is a volute spring. In a fourth embodiment, the resilient component is a curled flexure, and in a fifth embodiment the resilient component is a collapsible compression spring. A handle yoke may also interface with the resilient component to transition the mechanism from a first stable closed state to a second stable open state when the cradle is held stationary. The handle yoke is moved to a tripped position by the resilient component when the mechanism is tripped to transition to a third stable tripped state. The handle yoke can be used to reset the mechanism by reengaging the cradle with the latch assembly, adding elastic strain energy to the resilient component, and transition the mechanism to the open state. The components of the mechanism may provide a low mass and mass moment of inertia allowing high angular acceleration of the contact arm assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An actuation system, comprising:

a latch assembly configured to releasably engage a cradle;

a movable arm;

a resilient component comprising a first end having a revolute joint on the cradle and a second end connected to the movable arm, wherein the resilient component is elastically deformed and stores elastic strain energy in one of a first state or a second state when the latch assembly is engaged with the cradle and wherein the resilient component is in a third state that is not substantially elastically deformed and stores substantially no elastic strain energy when the latch assembly is not engaged with the cradle; and an input link engaged with the resilient component between the first end and the second end, wherein movement of the input link between a first position and a second position when the latch assembly is engaged with the cradle transitions the resilient component between the first state and the second state.

2. The actuation system of claim 1, wherein the input link comprises a yoke cam in communication with a yoke follower, and wherein movement of the input link from a third position to the second position transitions the mechanism to the second state in which the resilient component is under tension and the latch assembly is engaged.

3. The actuation system of claim 1, wherein the input link comprises a slot and the resilient component comprises a protrusion through which a complementary engagement structure between the resilient component and the input link is formed.

4. The actuation system of claim 1, wherein the input link comprises a pair of crossbars that contact the resilient component and through which the resilient component is configured to move.

5. The actuation system of claim 1, wherein the resilient component is attached rigidly to the respective movable arm.

6. The actuation system of claim 1, wherein the resilient component is attached to the respective movable arm via an offset revolute joint.

7. The actuation system of claim 1, wherein the respective movable arm is a contact arm configured to move between contacting and not contacting a stationary contact.

8. The actuation system of claim 1, wherein the respective movable arm is a contact arm assembly comprising a contact arm, crank, contact arm pivot, torsion spring, and contact arm hard stop configured to move between contacting and not contacting a stationary contact.

9. The actuation system of claim 1, wherein the respective movable arm is a contact arm assembly comprising a crank rotor, two contact arms, two contact arm revolute joints, and contact arm torsion springs configured to move between contacting and not contacting stationary contacts.

10. The actuation system of claim 1, wherein the at least one movable arm comprises two or more movable arms mounted on a common torsion bar connected to the mechanism.

11. The actuation system of claim 1, wherein the first state comprises a closed state in which the respective movable arm contacts a stationary contact and the second state comprises an open state in which the respective movable arm does not contact the stationary contact.

12. The actuation system of claim 1, wherein the third state comprises a tripped state in which the respective movable arm does not contact the stationary contact.

13. The actuation system of claim 1, wherein the actuation system comprises an electrical circuit breaker.

14. The actuation system of claim 1, wherein the input link is a handle yoke.

15. The actuation system of claim 1, wherein the resilient component comprises one of a leaf flexure element, a volute spring, a curled flexure, or a helical compression spring.

16. A circuit breaker assembly, comprising:

a latch assembly configured to releasably engage a cradle;

a movable arm configured to move between a closed circuit position and an open circuit position;

a leaf flexure comprising a first end having a revolute joint on the cradle and a second end connected to the movable arm.

17. The circuit breaker of claim 16, wherein the leaf flexure is in one of a first state corresponding to the closed circuit position or a second state corresponding to the open circuit position when the latch assembly is engaged with the cradle, and wherein the leaf flexure is in a third state corresponding to a tripped position when the latch assembly is not engaged with the cradle.

* * * * *